US005915298A

United States Patent [19]

Binnen

[11] Patent Number: 5,915,298

[45] Date of Patent: Jun. 29, 1999

[54] PRINT HEAD LIFTING DEVICE ON TAMPON PRINTING MACHINES

[76] Inventor: Georg Binnen, Wiesäcker 4, D-74182 Obersulm, Germany

[21] Appl. No.: 09/022,532

[22] Filed: Feb. 12, 1998

[30] Foreign Application Priority Data

Feb. 20, 1997 [DE] Germany ..... 297 02 950 U

[51] Int. Cl.[6] ..... B41F 17/00

[52] U.S. Cl. ..... 101/41; 101/163

[58] Field of Search ..... 101/35, 41, 42, 101/43, 44, 150, 163, 167, 169, 170

[56] References Cited

U.S. PATENT DOCUMENTS 4,615,266 10/1986 DeRoche et al. ..... 101/163

5,653,167 8/1997 DeVolder ..... 101/163

*Primary Examiner*—Edgar Burr
*Assistant Examiner*—Amanda B. Sandusky
*Attorney, Agent, or Firm*—Paul Vincent

[57] ABSTRACT

In order to fashion a print head lifting device of a tampon printing machine with as simple components as possible which is without play and of low maintenance, a crank link 3, 4, 6 is provided for having a driven crank 3 and a link 5 borne on a machine frame 1, wherein the connecting rod 4 is connected to a lifting lever 11 via a connecting lever 15 pivotably hinged at both sides, the one end of which is disposed on the machine frame 1 and the other end of which is pivotably connected to the longitudinally displaceable print head lifting rod 8.

9 Claims, 2 Drawing Sheets

PRINT HEAD LIFTING DEVICE ON TAMPON PRINTING MACHINES

This application claims Paris Convention priority of German utility model application No. 297 02 950.9 filed on Feb. 20, 1997, the complete disclosure of which is hereby incorporated by reference.

BACKGROUND OF THE INVENTION

In conventional tampon printing machines, the lifting of the print head along with the tampon is controlled either by means of a cam guide onto which a guide pin is pressed via spring loading, or by means of a curved groove with associated guide pin guided therein. In both cases, manufacture of the cam guide is time consuming and therefore expensive and substantial frictional losses result so that a relatively powerful drive must be used. In addition, the cam guides wear quickly due to the large amount of friction so that a relatively large amount of play results. It is therefore necessary to frequently replace the cam guide plates or the like.

SUMMARY OF THE INVENTION

It is the purpose of the present invention to create a lifting device which is free of play and of low maintenance using as simple components as possible. This is achieved in accordance with the invention by means of a connecting rod link having a driven connecting rod and a link borne on the machine frame, wherein the crank is pivotably connected, via a connecting lever pivotably hinged at both sides, to a lifting lever, one end of which is borne on the machine frame and the other end of which is pivotably connected to a longitudinally displaceable print head lifting rod. This type of construction avoids cam guides entirely and replaces them with a simple lever configuration which can be made free of play. In addition, frictional forces and therefore wear are essentially eliminated particularly in the lower region: i. e. when the tampon is pressed, the toggle lever system effects full force utilization.

It is preferable when the lifting lever is connected to the lifting rod and/or the machine frame and in an elastically flexible fashion. The pivoting motion of the lifting lever effects a small longitudinal motion in the axial direction. Although this can be neglected with very long lever arms, it requires substantial compensation for short lever arms. This is achieved through the elastic flexible bearing. Towards this end, in accordance with an additional feature of the invention, the lifting lever is attached to the machine frame by means of a flexible elastic member of high tensile strength, in particular a plate. Its connection to the lifting rod at its other end is preferentially effected via an elastic metallic-rubber bearing. This elastic mounting has the additional advantage that no particular amount of precision is required when producing the lever rod.

The lifting rod is preferentially connected to the lifting lever for rotation about the longitudinal axis of the lifting rod. The bearing positions of the connecting lever on the crank and the lifting lever can be selected according to need. It has, however, proven advantageous to dispose the pivot point below the middle in each case, in a direction towards the lifting rod or link respectively.

The drawing shows an embodiment of the invention.

DESCRIPTION OF THE PREFERRED EMBODIMENT

Figure 1:
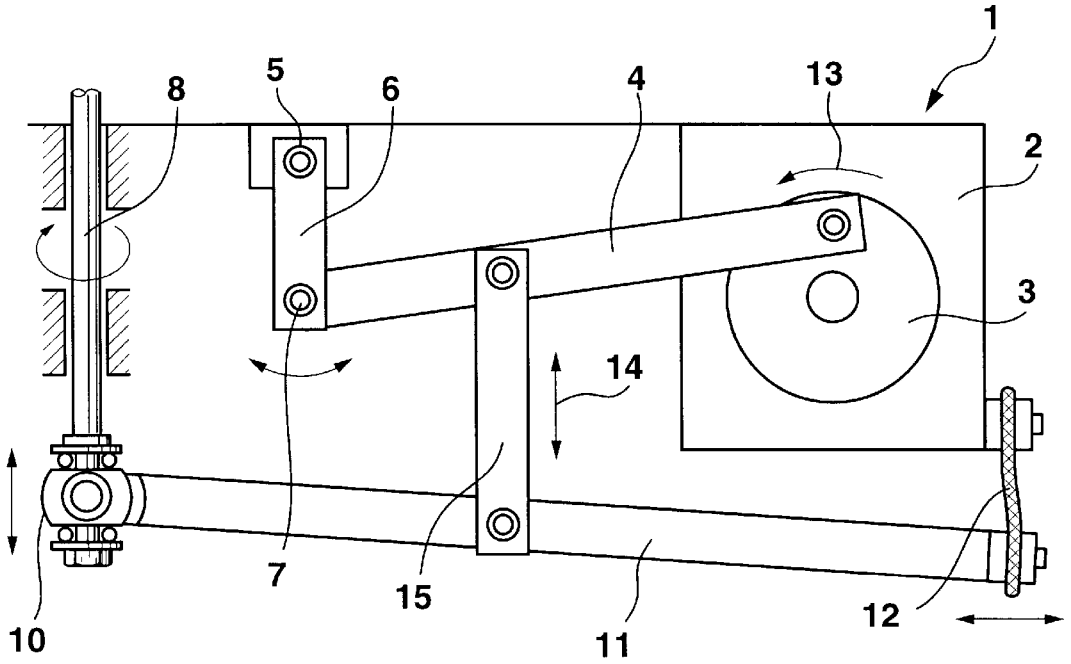
FIG. 1 shows a partially cut and broken front view of a print head lifting device.
Figure 2:
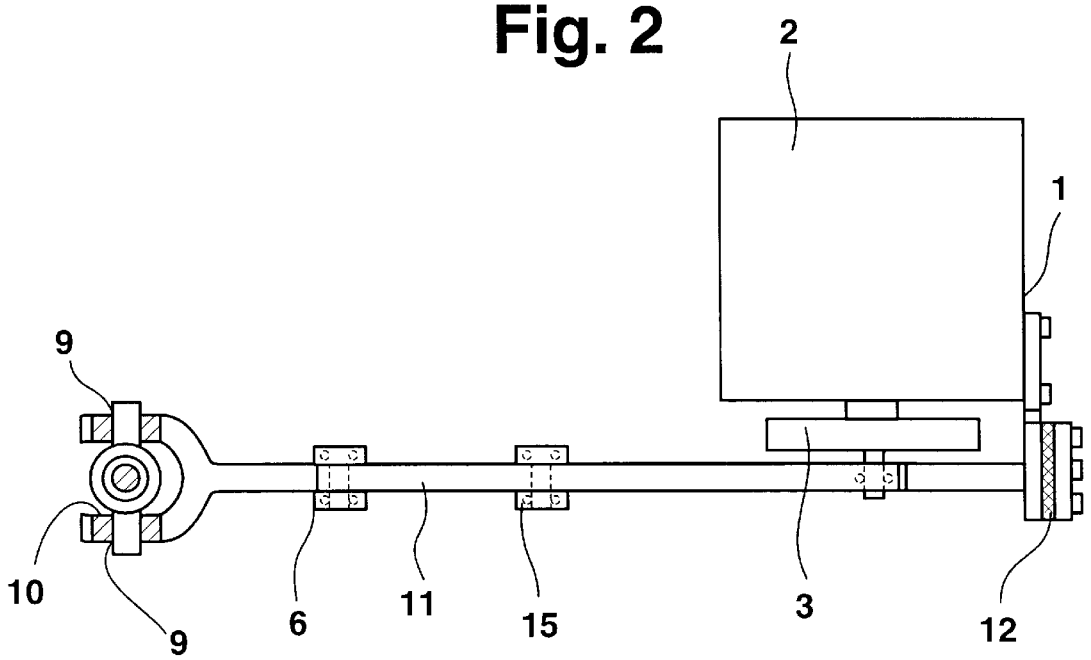
FIG. 2 shows a partially cut plan view according to FIG. 1.

A drive 2 disposed on machine frame 1, is connected to a crank 3 having pivotable attached connecting rod 4. A link 6 is disposed at position 5 on the machine frame 1 and is pivotably connected at its free end 7 to the connecting rod 4. The print head (not shown) is securely attached to the lifting rod 8 which can be longitudinally displaced in the axial direction. The free end of the lifting rod 8 is disposed, in a pivotable manner and rotatable about its longitudinal axis, in the metallic-rubber bearing 9 of the forked end 10 of a lifting lever 11. The other end of the lifting lever 11 is connected, via a flexible resilient plate 12 of high tensile strength, to the machine frame 1. A connecting lever 15 is disposed between the connecting rod 4 and the lifting lever 11 and is borne in a hinged fashion at both it ends.

Figure 3:
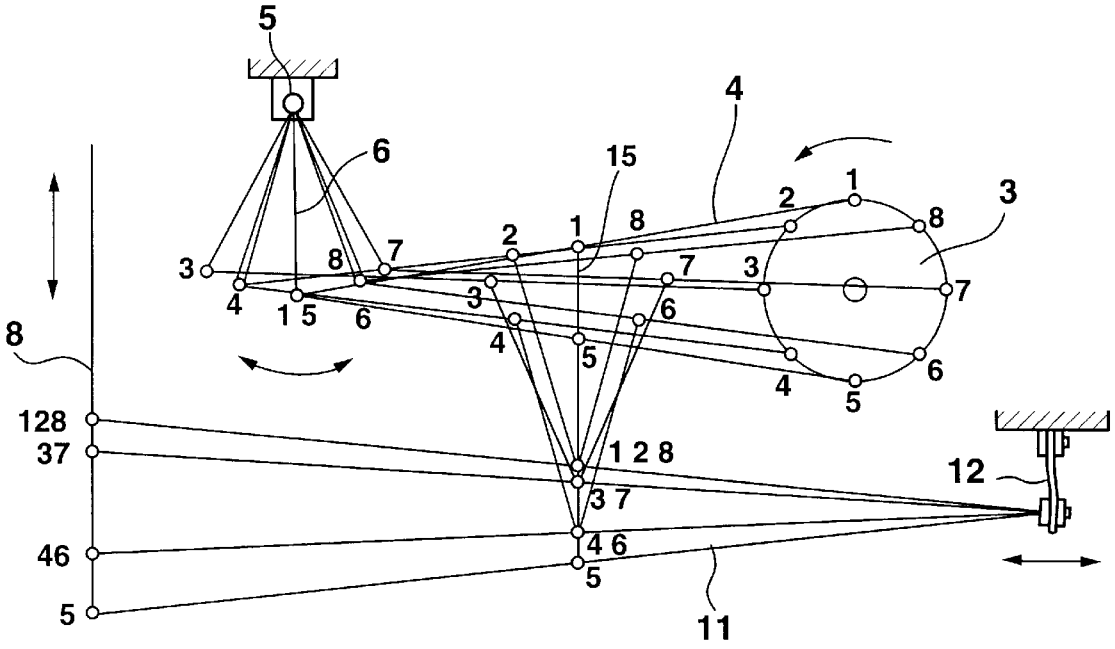
FIG. 3 shows a schematic representation according to FIG. 1.

When the crank 3 rotates in the direction of arrow 13, the connecting lever 15, pivotably connected to the connecting rod 4, has a component of back and forth motion in the direction of arrow 14 which is transferred to the lifting lever 11. Since same is connected to the machine frame 1 by means of the tensile elastic plate 12, it pivots about this point of rotation. The lifting rod 8, connected to the lifting lever 11, thereby executes a stroke motion. The resulting forced longitudinal motion of the lifting lever 11 is thereby accepted by the flexible resilient properties of the plate 12 and the metallic-rubber bearing 9. The device is shown schematically in FIG. 3, wherein the lifting motion of the lifting rod 8 is shown in dependance on the various positions of the crank 3. The lifting device in accordance with the invention effects the stroke dependence required for tampon printing machines. When the crank 3 is continuously rotated, the lifting rod 8 along with the print head seated thereon, describes an up-and-down motion with a stationary position at the upper reverse point.

I claim:

1. A print head lifting device for a tampon printing machine comprising a device frame;

a crank borne on said frame;

a link borne on said frame;

a connecting rod connected at a first end thereof to said crank, and at a second end thereof to said link;

a lifting lever connected at a first end to said frame and pivotably connected at a second end thereof to a longitudinally displaceable print head lifting rod; and a connecting lever pivotably hinged between said connecting rod and said lifting lever.

2. The device of claim 1, wherein said lifting lever is connected to said lifting rod in a flexible, resilient manner.

3. The device of claim 1, wherein said lifting lever is connected to said device frame in a flexible, resilient manner.

4. The device of claim 3, wherein said lifting lever is attached to said device frame via a resilient flexible member of high tensile strength.

5. The device of claim 4, wherein said flexible member consists essentially of a plate.

6. The device of claim 2, wherein said lifting lever is connected to said lifting rod via elastic metallic-rubber bearings.

7. The device of claim 1, wherein said lifting rod is connected to said lifting lever for rotation about a longitudinal axis of said lifting rod.

8. The device of claim 1, wherein said connecting lever is hinged to said lifting lever at a location having a second separation from said second lifting lever end smaller than a first separation from said first lifting lever end.

9. The device of claim 1, wherein said connecting lever is borne on said connecting rod at a location having a third separation from said second connecting rod end smaller than a fourth separation from said first connecting rod end.

* * * * *